US008444056B2

(12) United States Patent
Gamez et al.

(10) Patent No.: US 8,444,056 B2
(45) Date of Patent: May 21, 2013

(54) MULTI-COLORED VISISHOT PAPER TARGET

(75) Inventors: Jackie Gamez, Galesville, WI (US); David Nau, Onalaska, WI (US)

(73) Assignee: Alliant Techsystems Inc., Minneapolis, MN (US)

( * ) Notice: Subject to any disclaimer, the term of this patent is extended or adjusted under 35 U.S.C. 154(b) by 1428 days.

(21) Appl. No.: 11/432,021

(22) Filed: May 11, 2006

(65) Prior Publication Data

US 2007/0262529 A1 Nov. 15, 2007

(51) Int. Cl.
*G06K 19/00* (2006.01)

(52) U.S. Cl.
USPC ..... 235/487

(58) Field of Classification Search
USPC ..... 235/487; 273/409
See application file for complete search history.

(56) References Cited

U.S. PATENT DOCUMENTS

| | | | | |
|---|---|---|---|---|
| 3,353,827 | A | 11/1967 | Dun, Jr. | 273/102.1 |
| 3,423,092 | A | 1/1969 | Kandel | 273/102.1 |
| 3,895,803 | A | 7/1975 | Loe | 273/102 |
| 3,899,175 | A | 8/1975 | Loe | 273/102.1 |
| 5,186,468 | A | 2/1993 | Davies | 273/378 |
| 5,188,371 | A | 2/1993 | Edwards | 273/378 |
| 5,437,931 | A * | 8/1995 | Tsai et al. | 428/446 |
| 5,501,467 | A * | 3/1996 | Kandel | 273/378 |
| 5,580,063 | A | 12/1996 | Edwards | 273/378 |
| 5,676,401 | A * | 10/1997 | Witkowski et al. | 283/81 |
| 6,019,375 | A | 2/2000 | West, Jr. | 273/378 |
| 2004/0036221 | A1 * | 2/2004 | Martinez | 273/373 |
| 2007/0046760 | A1 * | 3/2007 | Zara | 347/105 |

* cited by examiner

*Primary Examiner* — Jamara Franklin
(74) *Attorney, Agent, or Firm* — Vidas, Arrett & Steinkraus, P.A.

(57) ABSTRACT

A target, made of two layers, that has an animal design. The animal design on the bottom layer has at least two zones which correspond to a level of effectiveness of a bullet strike within that zone. Each level of effectiveness is indicated by a color and each animal design has at least two levels of effectiveness.

19 Claims, 4 Drawing Sheets

MULTI-COLORED VISISHOT PAPER TARGET

CROSS-REFERENCE TO RELATED APPLICATIONS

Not Applicable

STATEMENT REGARDING FEDERALLY SPONSORED RESEARCH

Not Applicable

FIELD OF THE INVENTION

This invention relates to a target for firearms which, by means of an indicator mechanism with at least two colors, produces a substantially more visible indication of the point of projectile impact as well as a better indication of the location of the impact on the target.

BACKGROUND OF THE INVENTION

Firearms targets generally consist of a sheet of paper having the usual concentric circles and bull's-eye printed thereon. When a bullet hits a target it makes a hole in the target which is slightly smaller than the size of the bullet. The location of the hole in the target can be very difficult to determine at typical target range distances because of its small size and lack of contrast with the rest of the target. This is particularly difficult when using small caliber rounds, e.g. 0.22 inch diameter bullet. Therefore, it is desirable to have a target which helps the shooter see where the bullet has hit the target.

BRIEF SUMMARY OF THE INVENTION

In at least one embodiment, a target comprises a first layer having a surface. The surface has at least two zones thereon. Each zone has a size and a level of effectiveness. The level of effectiveness is indicated by a color and there are at least two levels of effectiveness.

In at least one embodiment, a target comprises a first layer and a second layer. The first layer of the target has a surface where at least two zones are printed on the surface of the first layer. The zones comprise at least two concentric circles with each concentric circle indicated by a color. The second layer of the target has a front surface and a back surface. The back surface of the second layer is engaged to the first layer and the front surface of the second layer has a contrasting color thereon. The contrasting color on the front surface overlays a substantial portion of each of the concentric circles on the surface of the first layer. The impact of a projectile causes the contrasting color on the second layer to be removed from the area surrounding a projectile impact point which causes the color on the first layer to be exposed.

In at least one embodiment, a target comprises a first layer and a second layer. The first layer of the target has a surface with at least two zones defining a point-of-aim design printed on the surface and each of the at least two zones is indicated by a color. The second layer of the target has a front surface and a back surface with the back surface of the second layer engaged to the first layer of the target. The front surface of the second layer has a contrasting color thereon where the contrasting color overlays a substantial portion of each of the point-of-aim zones on the first layer. The impact of a projectile causes the contrasting color on the second layer to be removed from the area surrounding the projectile impact point, which causes the color on the first layer to be exposed.

DETAILED DESCRIPTION OF THE INVENTION

Figure 1A:
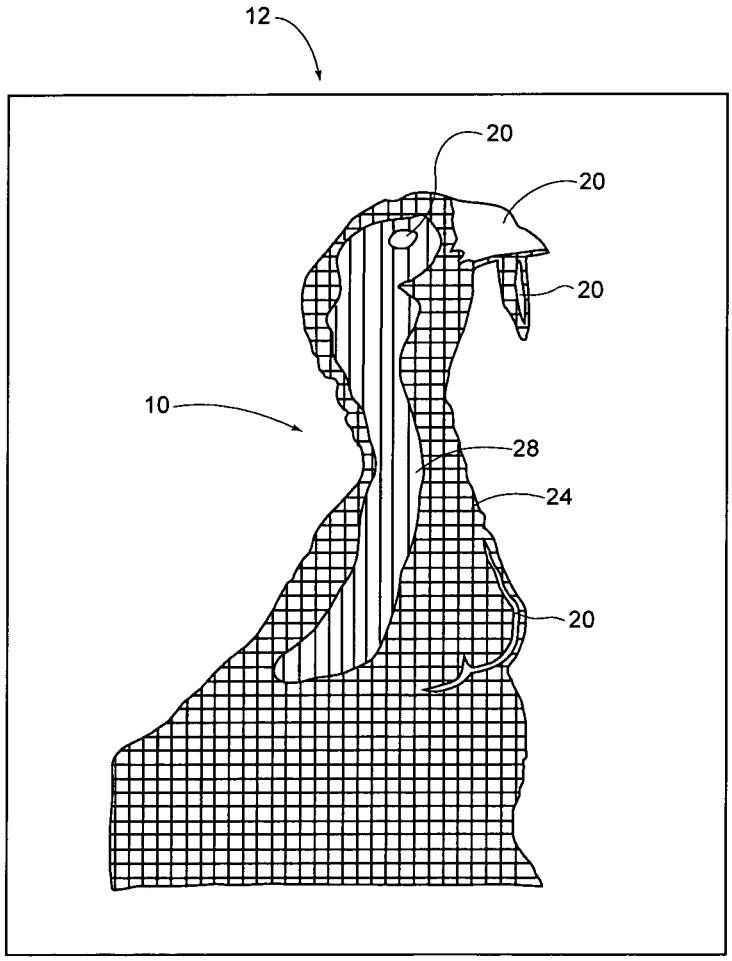
FIG. 1*a* is a view of an animal target with a bottom layer that has two zones.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

At least one embodiment provides a target with the outline of an animal with at least two zones on its body, each zone having a level of effectiveness that corresponds to the lethality of a bullet that hits that zone. Each level of effectiveness has a different contrasting color so the shooter can determine the lethality of his shot by the color of the zone the bullet hits. Since hunters prefer to kill the animal with the first shot by focusing on a particular zone or zones that can cause death when penetrated by a bullet, these targets enable the hunter to practice hitting the animal in the most lethal area(s) of the animal's body and to immediately visualize their accuracy without a spotting scope.

Figure 1B:
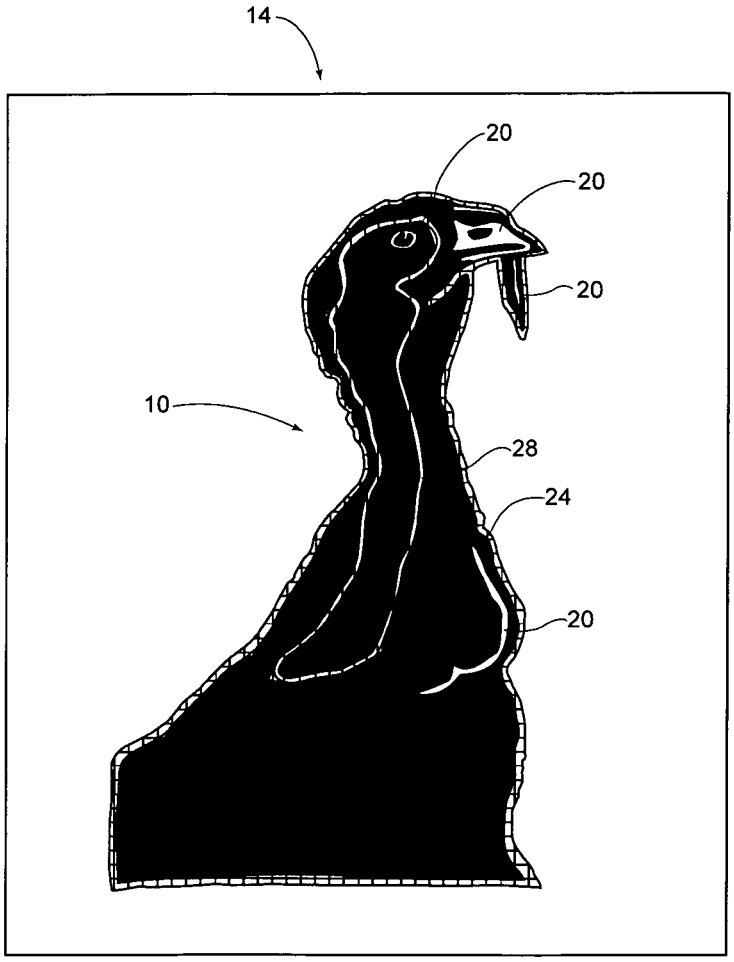
FIG. 1*b* is a view of the target of FIG. 1*a* with the top layer over the bottom layer.

FIGS. 1*a* and 1*b* depict a target 10 with a turkey design. The target 10 has a bottom layer 12 and a top layer 14. In at least one embodiment, the bottom layer 12 is manufactured from 8 pt. CIS white tag stock. However, it is within the scope of the invention for any suitable paper product to be utilized for the bottom layer 12. The bottom layer 12 has an outline of an animal that is the focus of the target 10. Any view of the animal may be used for the outline, for example, a front view, a side view, a rear view or any other view of the animal. Any animal may be outlined for the target 10, but usually an animal that is commonly pursued by hunters will be used for the target 10. Examples of commonly hunted animals include, but are not limited to, domestic game animals such as deer, coyote, prairie dog, sheep, bear, elk or exotic game animals, for example but not limited to, lion, gazelle, and water buffalo for hunters practicing for an overseas hunting expedition.

As depicted in FIG. 1*a*, the top surface of the bottom layer 12 in this embodiment has an outline of a turkey. Within the outline of the turkey there are two zones which have different levels of effectiveness, a moderately effective zone 24 and a most effective zone 28. A level of effectiveness is a measure of the degree to which a bullet hitting that particular area of the animal causes mortality. The colors used for the zones of effectiveness can be any color as long as they are visible from a distance and contrast with one another. In addition the color used for a particular effective zone should be consistent from one target to another. The visibility and contrast in colors is important because the different zones need to be distinguishable from one another and have the ability to be seen without a spotting scope.

In at least one embodiment, the color used for a zone with a particular level of effectiveness is the same among targets with different animal designs. Consistent color use among different targets allows a hunter to practice their skills on different animals which may have a different number of effective zones yet have at least one effective zone in common. Because a particular effective zone is the same color on different animal targets, the hunter will be able to associate a particular color with a particular level of effectiveness.

In the embodiment shown in FIG. 1*a*, there are two zones, a most effective zone 28 which is pink or red and a moderately effective zone 24 which is yellow. In at least one embodiment, the inks used to provide the color within the zones are flexographic water based inks, both PMS® and fluorescent colors. In at least one embodiment, in addition to the zones of effectiveness, there are areas that correspond to features of the animal which make the target 10 more lifelike. In this embodiment, these feature areas are white. The areas of white 20 are used for example, but not limited to, eyes, beak, paws or claws or hands, ears, nose or other distinguishing features of the target animal. In this embodiment, areas of white 20 are used for the beak, the eye and as an accent to the body of the turkey.

Figure 2:
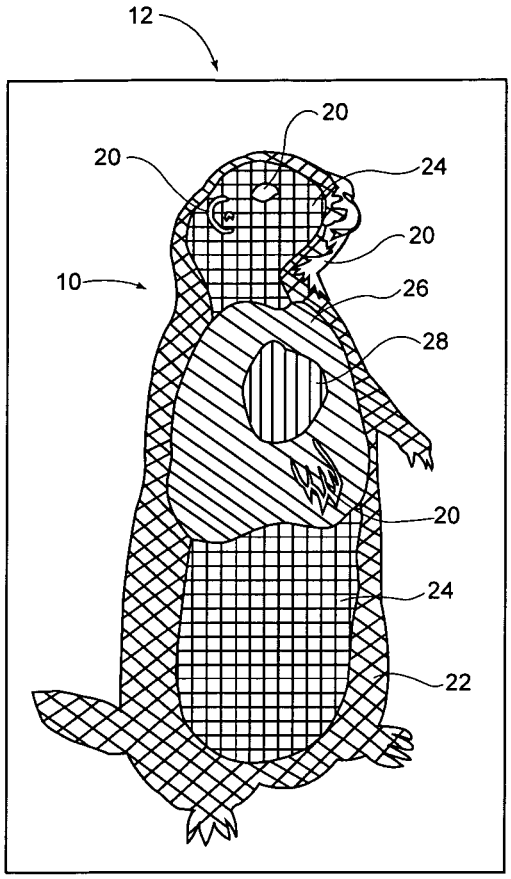
FIG. 2 is a view of an animal target with a bottom layer that has five zones with four levels of effectiveness.

FIG. 2 illustrates a target 10 with a different design printed on the top surface of the bottom layer 12. In this embodiment, the target 10 has a prairie dog design. Within the outline of the prairie dog there are five zones with four levels of effectiveness, a least effective zone 22, two a moderately effective zones 24, a highly effective zone 26, and a most effective zone 28. In this embodiment, the least effective zone 22 is orange, the moderately effective zones are yellow, the highly effective zone is green and the most effective zone 28 is pink or red.

A top layer 14 is engaged with the front surface of the bottom layer 12. The top layer 14 consists of a layer of laminate film. Any suitable laminate film can be used but in at least one embodiment the laminate film is a 0.8 mil clear self wound polypropylene film. On the top surface of the laminate film there is a layer of ink. The color of the layer of ink contrasts with the colors used for the zones of effectiveness on the bottom layer 12. FIG. 1*b* depicts how the target 10 looks when the top layer 14 with its layer of contrasting ink is engaged to the bottom layer 12. In at least one embodiment, the contrasting ink is composed of a layer of water based film series ink that is black and a coating of matte, water based varnish. In at least one embodiment, the contrasting ink is printed onto the top surface of the laminate film by a reverse printing method. This method of printing allows the color from the outermost edges of the zones on the bottom layer 12 to be seen through the top layer 14 because the contrasting ink does not cover the entire zone below.

In at least one embodiment, the contrasting ink on the laminate film hides all of the color from the bottom layer 12. Then, outlines of the zones of effectiveness on the bottom layer 12 are printed on the contrasting ink. The colors used for the different outlines correspond to the color of the zone being outlined.

In at least one embodiment, the contrasting ink on the laminate film hides all of the color on the bottom layer 12. In this embodiment, the shooter cannot see any outlines of the zones of effectiveness. Since animals do not have zones of effectiveness on their body, this embodiment would allow an experienced shooter to simulate a more realistic hunting scenario and the effectiveness of a shot would be discovered by viewing the color revealed by the halo.

Figure 3:
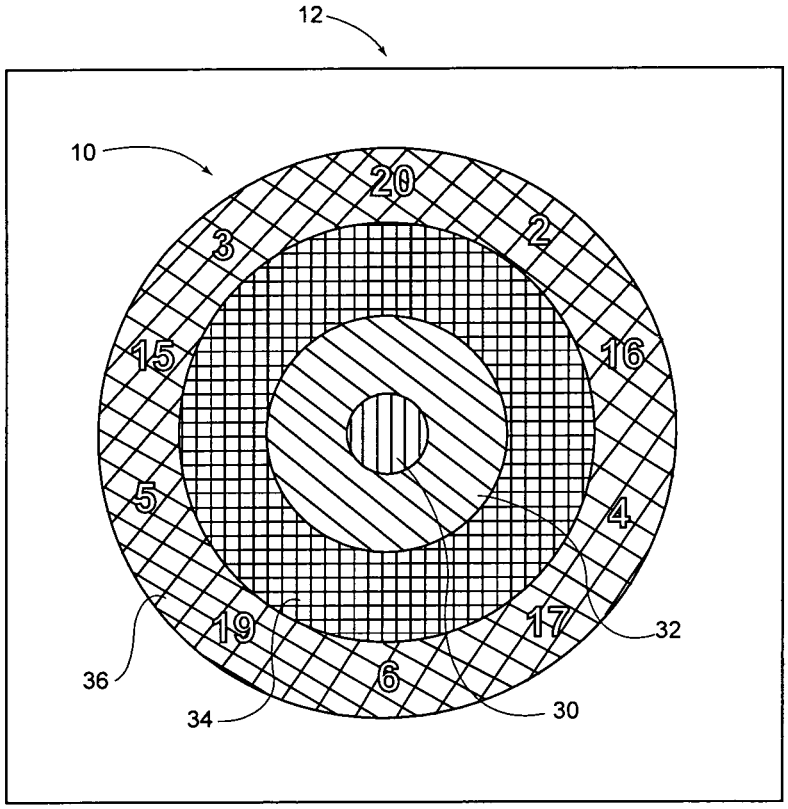
FIG. 3 is a view of a target with a bottom layer that has a dartboard design.

In at least one embodiment, shown in FIG. 3, the top surface of the bottom layer 12 of the target 10 has a dartboard design 20 which consists of at least two concentric circles. In this embodiment, there are four concentric circles. However, it is within the scope of the invention to have five, six, seven, eight or more concentric circles. The innermost circle 30 is indicated by a pink or red color. The first concentric circle 32, circle 1, is indicated by a green color. The second concentric circle 34, circle 2, is indicated by a yellow color. The third concentric circle 36, circle 3, is indicated by an orange color except for numbers that indicate a point value for the sections. It is within the scope of the invention for any color to be used for the concentric circles so long as the colors chosen contrasted with each other.

The top layer 14 of the target 10 is a layer of film which is engaged to the top surface of the bottom layer 12. On top of the layer of film is a layer of contrasting ink. The color of the contrasting ink is different from the colors used for the zones on the bottom layer 12, thus it is a contrasting ink. In at least one embodiment, the contrasting ink is composed of a layer of water based film series ink that is black and a coating of matte, water based varnish. As discussed above, the contrasting ink can be applied in two ways, either a reverse printing method where the outlines of the different circles as well as the numbers in the third concentric circle 36 are not covered by the contrasting ink or by covering the bottom layer entirely with the contrasting ink and printing the outlines on top of the contrasting ink. In this embodiment, the outlines delineate each concentric circle and the sections within the middle two concentric circles 32, 34, which are divided into sections.

In at least one embodiment, the dartboard design is used for shooting games. One game is to have two shooters take turns shooting at the target, with the person who spells the word CHAMPION (or any other agreed upon word) being the less accurate shooter. The game begins with the first shooter making a shot. The second shooter must match the shot or receive the first letter 'C'. If the first shooter misses, i.e. does not make the shot, the second shooter can shoot anywhere on the target. The game continues until one of the shooters spells the word CHAMPION and is eliminated.

Another game to be played with the dartboard design is one where two shooters compete to get the highest score. Each shooter takes five shots at the target and then adds the number of points earned with each shot. The innermost circle is worth 50 points and the outermost circle, the orange concentric circle is worth 0 points. Shots that hit outside the center circle have a varying point value depending on whether it hits in the green concentric circle or the yellow concentric circle and which section of the dartboard it hits. If the bullet hits in the green concentric circle, the player multiplies 2 times the value of the section the hit is in. If the bullet hits in the yellow concentric circle, the player multiplies 1 times the value of the section the hit is in. If the bullet hits on the line between two concentric circles, the hit receives the higher point value.

In one embodiment, not shown, the bottom layer of the target has a bull's-eye design on the top surface. The bull's-eye consists of at least two concentric circles with the innermost circle being the bull's-eye. In this embodiment, there are five concentric circles. However, it is within the scope of the invention to have two, three, four, six, seven, eight, or more concentric circles. The bull's-eye is indicated by a pink or red color. The first concentric circle, circle 1, is indicated by a yellow color except for two number 1s which are printed next to the horizontal axis of the bull's-eye and next to the vertical axis of the bull's-eye. The second concentric circle, circle 2, is indicated by an orange color except for two number 2s which are printed next to the horizontal axis of the bull's-eye and next to the vertical axis of the bull's-eye. The third concentric circle, circle 3, is indicated by a green color except for two number 3s which are printed next to the horizontal axis of the bull's-eye and next to the vertical axis of the bull's-eye. The fourth concentric circle, circle 4, is indicated by an orange color except for two number 4s which are printed next to the horizontal axis of the bull's-eye and next to the vertical axis of the bull's-eye. The numbers associated with each concentric circle indicate the number of inches the outmost boundary of the ring is from the center of the target.

A layer of laminate film is engaged to the top surface of the bottom layer. On top of the layer of laminate film there is a layer of contrasting ink and then a layer of varnish. As discussed above, the layers of ink and varnish can be applied in two ways, either a reverse printing method where the outlines of the different circles and the numbers are not covered by the contrasting ink or by covering the bottom layer entirely and printing the outlines and the numbers on top of the contrasting ink. The outlines in this embodiment delineate the edges of the concentric circles and bisect the bull's eye into four quadrants.

With all embodiments described herein, when a bullet hits the target the contrasting ink on the top layer flakes off revealing the color on the bottom layer of the target. Thus, a halo, which is larger than the size of the bullet impact, is formed when the bullet impacts the target. The size of the halo produced by the bullet impact can be changed by adjusting the viscosity, pH and coat weight of the ink and varnish in relation to one another. Adjusting the size of the halo permits the manufacturer to produce targets for a specific caliber or for a range of calibers.

In embodiments where colored ink is used to outline on top of the layer of contrasting ink, the colored ink flakes off along with the contrasting ink when a bullet hits the target.

What is claimed is:

1. A target comprising a first layer, the first layer having a surface, the surface having a target image comprising at least two zones, each zone having a size and a level of lethality, each level of lethality being indicated by a different color, and the target including at least two zones with different levels of lethality.

2. The target of claim 1, wherein the at least two zones define an animal design.

3. The target of claim 1, further comprising a second layer, the second layer having a front surface and a back surface, the back surface of the second layer in contact with the surface of the first layer, the front surface of the second layer having a contrasting color thereon, whereby the impact of a projectile causes the contrasting color on the second layer to be removed from the area surrounding a projectile impact point thereby causing the color on the first layer to be exposed.

4. The target of claim 3, further comprising at least two outlines, the at least two outlines printed on the contrasting color, each outline corresponding to a zone on the first layer and having the same color as the corresponding zone.

5. The target of claim 3, wherein the second layer is manufactured from 0.8 mil clear self wound polypropylene film.

6. The target of claim 3, wherein the contrasting color on the second layer is a flake-off ink, the flake-off ink comprising a bottom layer and a top layer, the bottom layer a water based film series ink and the top layer a matte, water based varnish.

7. The target of claim 6 wherein the flake-off ink is black.

8. The target of claim 3, wherein the contrasting color is reverse printed on the front surface of the second layer.

9. The target of claim 8 wherein the second layer is manufactured from 0.8 mil clear self wound polypropylene film.

10. The target of claim 8, wherein the contrasting color on the second layer is a flake-off ink, the flake-off ink comprising a bottom layer and a top layer, the bottom layer a water based film series ink and the top layer a matte, water based varnish.

11. The target of claim 10, wherein the flake-off ink is black.

12. The target of claim 1 wherein the first layer is manufactured from eight point CIS white tag stock.

13. The target of claim 1, wherein a flexographic water base ink is used for the color of each zone on the first layer.

14. The target of claim 1 wherein there are two levels of lethality, a least lethal level and a most lethal level.

15. The target of claim 1 wherein there are four levels of lethality, a least lethal level, a moderately lethal level, a highly lethal level and a most lethal level.

16. The target of claim 1 wherein there is only one zone for each level of lethality.

17. A target comprising a first layer, the first layer having a first surface, the first surface having a target design comprising a first color and a second color, the first color being different than the second color;

a second layer, the second layer having a front surface and a back surface, the back surface of the second layer touching the first surface of the first layer, the second layer being transparent; and a third layer, the third layer disposed over the second layer, the third layer having a third color, the third color being different than the first color and the second color;

the material of the third layer being frangible so that when impacted by a projectile an area of the third layer surrounding an impact point is removed whereby a portion of the target design is visible through the second layer.

18. A target comprising a first layer and a second layer, the first layer having a surface, a point-of-aim design printed on the surface of the first layer, the point-of-aim design comprising a first zone and a second zone, the first zone being a first color and the second zone being a second color different than the first color, the second layer having a front surface and a back surface, the back surface of the second layer engaged to the first layer, the front surface of the second layer having a contrasting color thereon, the contrasting color overlaying a substantial portion of each of the point-of-aim zones on the first layer, whereby the impact of a projectile causing the contrasting color on the second layer to be removed from the area surrounding the projectile impact point, thereby causing the color on the first layer to be exposed.

19. The target of claim 18, wherein the point-of-aim design being a bull's eye design or a silhouette of an animal.

* * * * *

UNITED STATES PATENT AND TRADEMARK OFFICE

CERTIFICATE OF CORRECTION

PATENT NO. : 8,444,056 B2
APPLICATION NO. : 11/432021
DATED : May 21, 2013
INVENTOR(S) : Gamez et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 2127 days.

Signed and Sealed this
Eleventh Day of November, 2014

Michelle K. Lee

Michelle K. Lee
*Deputy Director of the United States Patent and Trademark Office*